US010959474B1

(12) United States Patent
Le

(10) Patent No.: US 10,959,474 B1
(45) Date of Patent: Mar. 30, 2021

(54) DEVICE TO SECURELY LOCK A HELMET TO A SUPPORTING STRUCTURE

(71) Applicant: Billy Huu Le, Union City, CA (US)

(72) Inventor: Billy Huu Le, Union City, CA (US)

( * ) Notice: Subject to any disclaimer, the term of this patent is extended or adjusted under 35 U.S.C. 154(b) by 0 days.

(21) Appl. No.: 16/988,606

(22) Filed: Aug. 8, 2020

(51) Int. Cl.
*A24B 3/04* (2006.01)
*A42B 3/04* (2006.01)

(52) U.S. Cl.
CPC ..... *A42B 3/0413* (2013.01)

(58) Field of Classification Search
CPC ... A42L 33/0413; E05B 73/00; F16M 13/022; B62J 11/24; B62J 9/14
USPC ..... 70/57–61, 233–235; 2/6.2; 248/214, 248/221.11, 551–553; 224/420, 425, 431, 224/441, 448, 451, 569
See application file for complete search history.

(56) References Cited

U.S. PATENT DOCUMENTS 2,202,472 A * 5/1940 Tornblom ..... B60Q 1/0483 248/551
2,344,683 A * 3/1944 Dow, Jr. ..... 24/569
3,436,936 A * 4/1969 Arthur ..... A42B 3/0413 70/59
3,529,451 A * 9/1970 McOsker ..... B62J 11/24 70/59
3,581,531 A * 6/1971 Hediger ..... B62J 11/24 70/59
3,646,786 A 3/1972 Baker
3,759,072 A * 9/1973 McLarnon ..... B62J 11/24 70/59
3,779,597 A * 12/1973 Uchida ..... B62J 11/24 296/37.15
3,823,856 A * 7/1974 Uchida ..... B62J 11/24 224/459
3,837,545 A * 9/1974 Rogers, Jr. ..... B62J 11/24 224/446
4,024,738 A * 5/1977 Pi ..... B62J 11/24 70/59
4,118,960 A * 10/1978 Lipschutz ..... B62J 11/24 70/59
4,201,398 A * 5/1980 Meier ..... B62J 11/24 70/59

(Continued)

FOREIGN PATENT DOCUMENTS

WO 2014170285 A1 10/2014
WO 2017158207 A1 9/2017

OTHER PUBLICATIONS

Sato Racing, "Helmet Lock", https://www.satoracing.com/index_helmetlocks.htm [date accessed: May 18, 2020].

(Continued)

*Primary Examiner* — Lloyd A Gall
(74) *Attorney, Agent, or Firm* — Binita J. Singh; Thomas E. LaGrandeur; Bold IP, PLLC

(57) ABSTRACT

A helmet locking device that allows a rider to securely lock the helmet to a supporting structure, such as a motorcycle. The device includes a mounting bracket configured to conform to and fit around a tubular structure on the motorcycle. The device also includes an anchoring member that is mounted on to the helmet. The mounting bracket and the anchoring member include elements that allow them to be slidably coupled to each other and secured by a locking element thus preventing the removal and theft of the helmet.

21 Claims, 5 Drawing Sheets

(56) References Cited

U.S. PATENT DOCUMENTS 4,274,271 A * 6/1981 Todd ..... A42B 3/0413 70/59
6,415,635 B1 * 7/2002 Jonasson ..... B62J 11/24 70/59

OTHER PUBLICATIONS

Revzilla, "Kuryakyn Universal Chrome Helmet Lock," https://www.revzilla.com/motorcycle/kuryakyn-universal-chrome-helmet-lock [date accessed: May 18, 2020].

* cited by examiner

DEVICE TO SECURELY LOCK A HELMET TO A SUPPORTING STRUCTURE

TECHNICAL FIELD

The technical field generally relates to locking devices and, more particularly, to securely locking or fixing a helmet to a vehicle such as a motorcycle.

BACKGROUND

Motorcycle riding is popular, and people buy motorcycles out of a passion for the product or lifestyle. Increasingly, there are also riders that are motivated to ride motorcycles for practical reasons such as ease of commute. All of these incentives to ride have made motorcycles a popular means of transportation and recreation. Motorcycle riding also requires some safety measures that the rider must take. There are plenty of essential motorcycle gear that can boost safety, and key among them is the helmet. Wearing a helmet while riding is universally becoming a legal requirement.

A motorcycle helmet is as important a part of the motorcycle as any other component. Thus, carrying a helmet has brought on the issue of what to do with the helmet after parking the motorcycle in a public place. In the absence of a suitable means to secure the helmet to the motorcycle, riders will carry the helmet with them or in some cases leave them with the motorcycle. Carrying the helmet with a person is inconvenient and leaving the helmet unsecured with the motorcycle poses the problem of theft. To that extent, motorcycle enthusiasts and manufacturers have sought to find ways to theft-proof the helmet when left with the motorcycle.

Several approaches have been taken to store the helmet with the motorcycle. Some approaches use a cable and lock design where a cable may be looped through the helmet strap or another opening on the helmet. However, there are drawbacks to this design because the cable or the strap can be cut through, the device is unsightly, and it also needs to be stored away when not in use. Another approach has been to mount a lock device with a D-ring directly onto the motorcycle but the means of attaching the helmet to this lock either requires removably attaching an anchor that can attach to some part of the helmet and then locked into the D-ring or the helmet chin strap can be put through the D-ring. These are not very secure and also do not allow the helmet to rest properly, causing damage to the motorcycle or the helmet itself.

Thus, there remains a need for a device that makes it possible for riders to conveniently store their helmets with the motorcycle in a way that makes its theft difficult and also the helmet and the motorcycle are not damaged when locking the helmet. The present invention addresses the need for an improved device for securely locking a helmet to a vehicle, such as a motorcycle.

SUMMARY

Accordingly, the present disclosure provides a device for securely locking an article, such as a helmet to a vehicle, such as a motorcycle.

In a preferred embodiment, the helmet securing device is comprised of a mounting bracket that engages with an anchoring member to securely lock a helmet to a motorcycle. The mounting bracket is configured to be coupled or affixed to a supporting structure. The supporting structure may be a tube-shaped structure on a motorcycle such as a bar that protects the legs of a rider, the handlebar, or any other tube-shaped structure on the motorcycle. The anchoring member is adapted to be fixedly mounted on a hull of a helmet.

The mounting bracket is comprised of a clamp piece, a swivel piece, and a locking device. The clamp piece is comprised of two pieces which are adjoined together around the supporting structure. One of the clamp pieces and the swivel piece are configured with an aperture so that the pieces are affixed to each other with a bolt. The two pieces further include grooves immediately around the apertures on the sides abutting each other, which allows the grooves to engage or disengage with each other when the bolt is tightened or loosened, respectively. The swivel piece is further designed with two parallel extending arms with space between the two such that the locking piece may be positioned between the two arms. The arms and the locking piece are provided with apertures which line up such that a bolt may be passed through to hold the locking piece within the swivel piece. The locking piece may swivel at this position. The locking device has a grooved section with a lock that extends through this section. The grooved section will engage with the anchoring member.

The anchoring member is fixedly mounted to the hull of the helmet. A tab extends upward from the flat piece of the anchoring member and is designed to be complementary to the grooved piece on the locking device such that the grooved section may slide over the tab on the anchoring member. The tab on the anchoring member is further provided with an aperture which engages with the lock on the locking device and when locked.

The presently disclosed helmet securing device provides an improved system for securely locking a helmet to a supporting structure, such as a motorcycle. The system includes the mounting bracket attached to the supporting structure, the anchoring member affixed to the helmet, and sliding the locking piece on the mounting bracket over the anchoring member and locking the two in place with a lock.

The presently disclosed helmet securing device for securely locking a helmet to a supporting structure is further described in the attached drawings and detailed description below.

DETAILED DESCRIPTION

Figure 1:
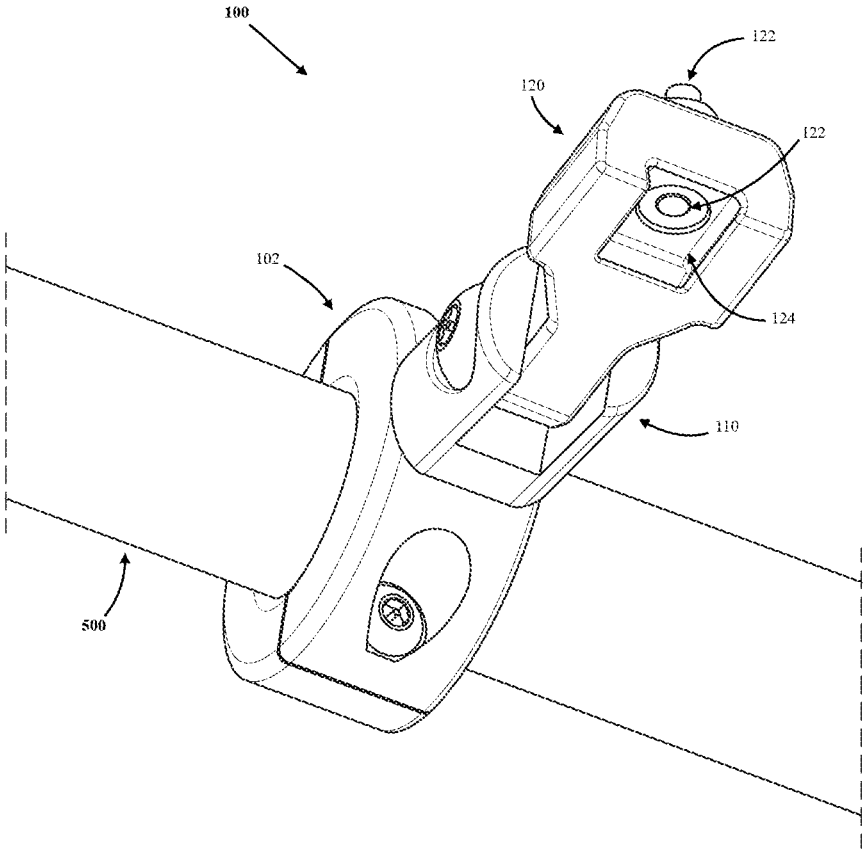
FIG. 1 illustrates a perspective view of an assembled mounting bracket of a helmet securing device.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises," and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

The following description provides preferred exemplary embodiments only, and is not intended to limit the scope, applicability, or configuration of the invention. The following description of the preferred exemplary embodiment will provide those skilled in the art with an enabling description for implementing a preferred exemplary embodiment of the invention. It shall be understood that various changes may be made in the function and arrangement of elements without departing from the scope of the invention as set forth in the claims.

The presently disclosed device enables a rider to securely connect a helmet to a motorcycle when not in use. The device may be attached to the motorcycle and to a back of the helmet, essentially allowing the rider to removably secure the helmet to the motorcycle. The device allows the helmet to be secured to the helmet in such a way as to prevent theft. The helmet securing device is comprised of a mounting bracket that engages with an anchoring member to securely lock a helmet to a motorcycle. The mounting bracket is configured to conform to and be affixed to a supporting structure. The supporting structure may be a tube-shaped structure on a motorcycle such as a bar that protects the legs of a rider, the handlebar, or any other tube-shaped structure on the motorcycle. The tube-shaped structure may have a cross section of any shape including, but not limited to, circular, square, rectangular, oval, triangular, trapezoidal, and polygonal (such as pentagonal, hexagonal, and so forth). The anchoring member is adapted to be fixedly mounted on a hull of a helmet.

In a preferred embodiment, the mounting bracket is comprised of a clamp, a swivel piece, and a locking piece. The mounting bracket may be fashioned from a sufficiently strong material which may include, but is not limited to, steel, aluminum, metal alloys, plastics, resins, and combinations thereof. The clamp may be comprised of two C-shaped pieces which are positioned around the supporting structure and fixed in place with screws adjoining the two C-shaped pieces such as to prevent the clamp from sliding on the supporting structure. In alternate embodiments, the clamp may also be fashioned to conform to the different cross-sectional shapes of the supporting structure.

In a preferred embodiment, one of the C-shaped pieces of the clamp piece is adapted to be fixedly connected to the swivel piece with a bolt. The bolt is passed through an aperture in the middle of the C-shaped clamp piece and an aperture in the middle of the swivel piece. The clamp piece and the swivel piece both are characterized as having grooves around the apertures on the portions that abut each other such that the grooves engage with each other and hold the pieces in place and prevent them from rotating when the bolt is tightened. Loosening the bolt allows the clamp piece and the swivel piece to loosen and also disengage at the grooves to permit the swivel piece to rotate. This feature provides flexibility to adjust the position of the locking piece which is connected to the swivel piece such that a helmet may rest properly with the support of gravity depending on the location of the supporting structure.

The swivel piece is further connected to the locking piece. The swivel piece is designed with two parallel arms that extend perpendicularly away from the portion that connects to the clamp. This design creates an opening between the two arms so the locking piece may be positioned between the opening. The swivel piece further includes an aperture that extends through each arm and are positioned such that a bolt may be threaded through these apertures. The swivel piece may be characterized as having a swivel end and a rotational end. The rotational end is connected to the C-shaped clamp piece and the swivel end is connected to the locking piece.

In this preferred embodiment, the locking piece is fashioned so it is preferably positioned between the extended parallel arms of the swivel at the swivel end. The locking piece includes an aperture on the end that is arranged between the extended arm of the swivel and positioned such that the apertures on the swivel end and the locking piece align and are connected with a bolt that extends through these pieces. By having the locking piece positioned and arranged as such, the locking piece may swivel with the extended arms of the swivel at the bolt and rest naturally in a position with the support of gravity.

In a preferred embodiment, the locking piece, as the name suggest, also includes a lock. The lock is arranged and positioned at the end opposite the end that connects to the swivel piece. The lock may preferably include, and not be limited to, a push lock. The lock design may also include, and not be limited to, mortise cylinder, rim cylinder, key-in-cylinder, and key-lever locks. The locking piece is also configured to be positioned over and engage with the anchoring member arranged on the helmet. The configuration is characterized by the locking piece having a grooved section on the bottom side which is designed to slide over a protrusion on the anchoring member. The lock is arranged on the top side of the locking member and extends through the grooved section.

In a preferred embodiment, the anchoring member is also a part of the helmet locking device. In this preferred embodiment, the anchoring member may be generally described as a flat plate and have any geometric shape, including and not limited to, circular, square, rectangular, oval, triangular, trapezoidal, and polygonal (such as pentagonal, hexagonal, and so forth). The anchoring member may be fashioned from materials including, and not limited to, rubber, plastics, resins, foam, and combinations thereof. The anchoring member is adapted to be fixed to the shell of the helmet with rivets, and preferably positioned on the back of the helmet near the edge that rests on the nape of a person wearing the helmet.

The anchoring member is designed to engage with the grooved section of the lock piece. The anchoring member has a cooperating portion to the groove of the lock piece that is designed as a tab extending from the plate. The tab on the anchoring member is further configured with an aperture that aligns with the lock on the lock piece. The locking piece and anchoring member are operatively coupled when the locking piece slides over the tab on the anchoring member. The lock is operated by means of a key which as a whole configures locking and unlocking means. The lock is moved into a locked position when it is positioned in the aperture in the tab of the anchoring member. Similarly, the lock is moved into an unlocked position when it is released from the aperture in the tab of the anchoring member.

Figure 2:
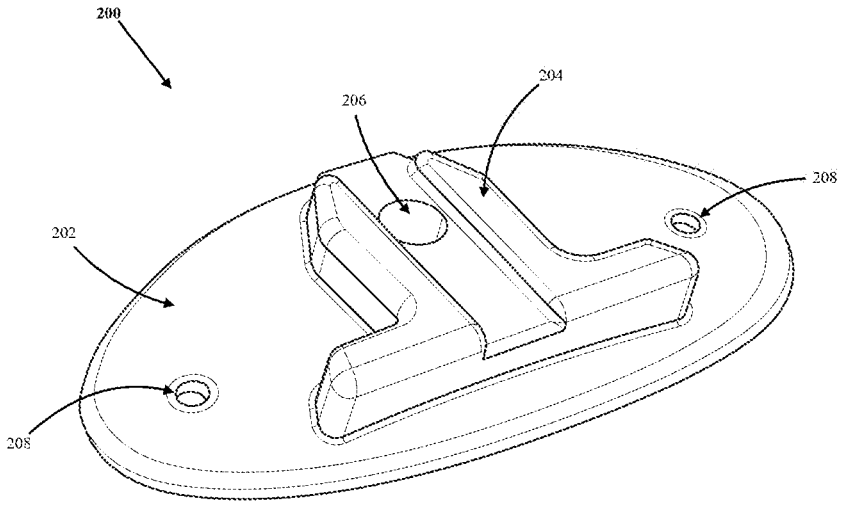
FIG. 2 illustrates a perspective view of an anchoring member of a helmet securing device.

An exemplary configuration of a helmet locking device is shown in the accompanying figures. With reference to FIG. 1 and FIG. 2, a non-limiting preferred embodiment of an improved helmet locking device is shown. In the preferred embodiment, an improved helmet locking device assembly is generally comprised of a mounting bracket 100 and an anchoring member 200. The mounting bracket 100 may be described as a support structure to which the anchoring member 200 with a helmet may be attached to.

Figure 5:
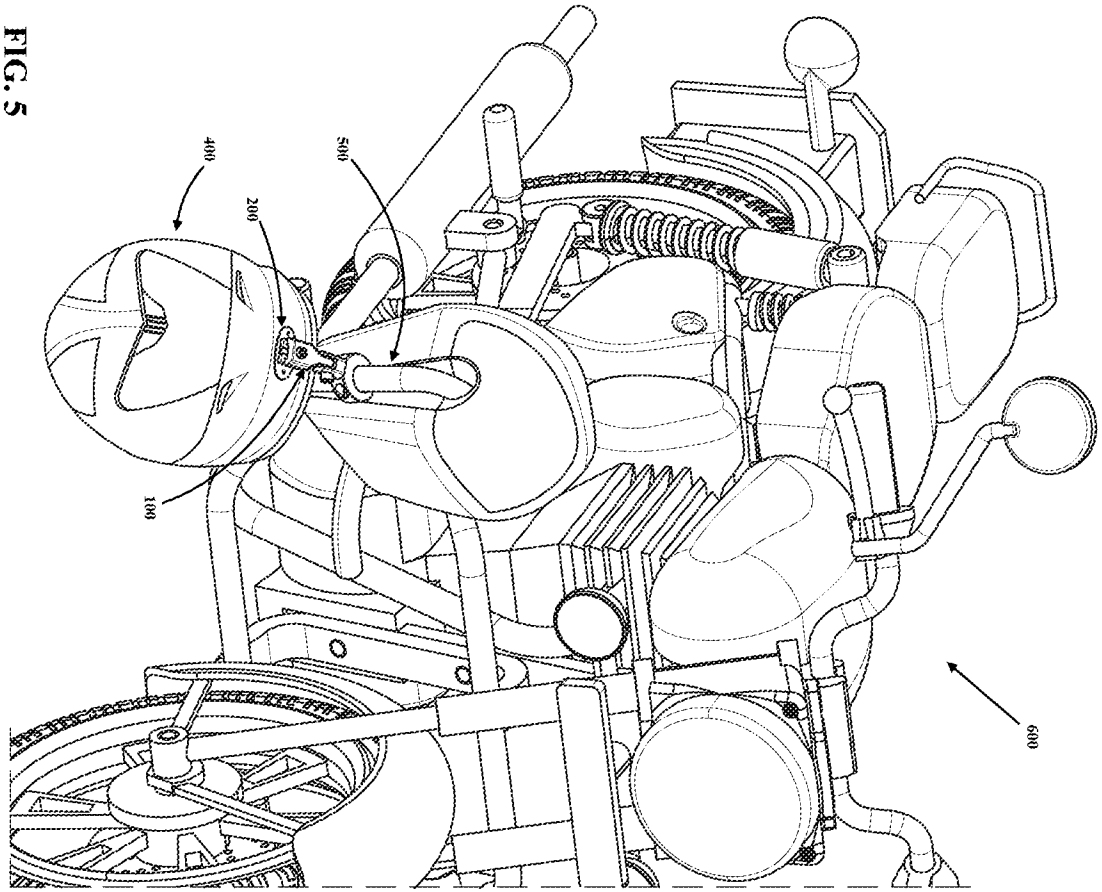
FIG. 5 illustrates a perspective view of a helmet securing device on a motorcycle securely holding a helmet.

As illustrated in FIG. 1, an assembled mounting bracket 100 is shown connected to a supporting structure 500. The mounting bracket 100 is comprised of a clamp piece 102, a swivel piece 110, and a locking piece 120. The mounting bracket 100 is designed to securely wrap around the supporting structure 500 that may be a part of a motorcycle. The supporting structure 500 may be a tube-shaped structure on the motorcycle such as a bar that protects the legs of a rider (as shown in FIG. 5), the handlebar, or any other tube-shaped structure on the motorcycle. The supporting structure 500 may have a cross section of any shape including, but not limited to, circular, square, rectangular, oval, triangular, trapezoidal, polygonal (such as pentagonal, hexagonal, and so forth). The mounting bracket 100 may be fashioned from a sufficiently strong material which may include, but is not limited to, steel, aluminum, metal alloys, plastics, resins, and combinations thereof.

Figure 3:
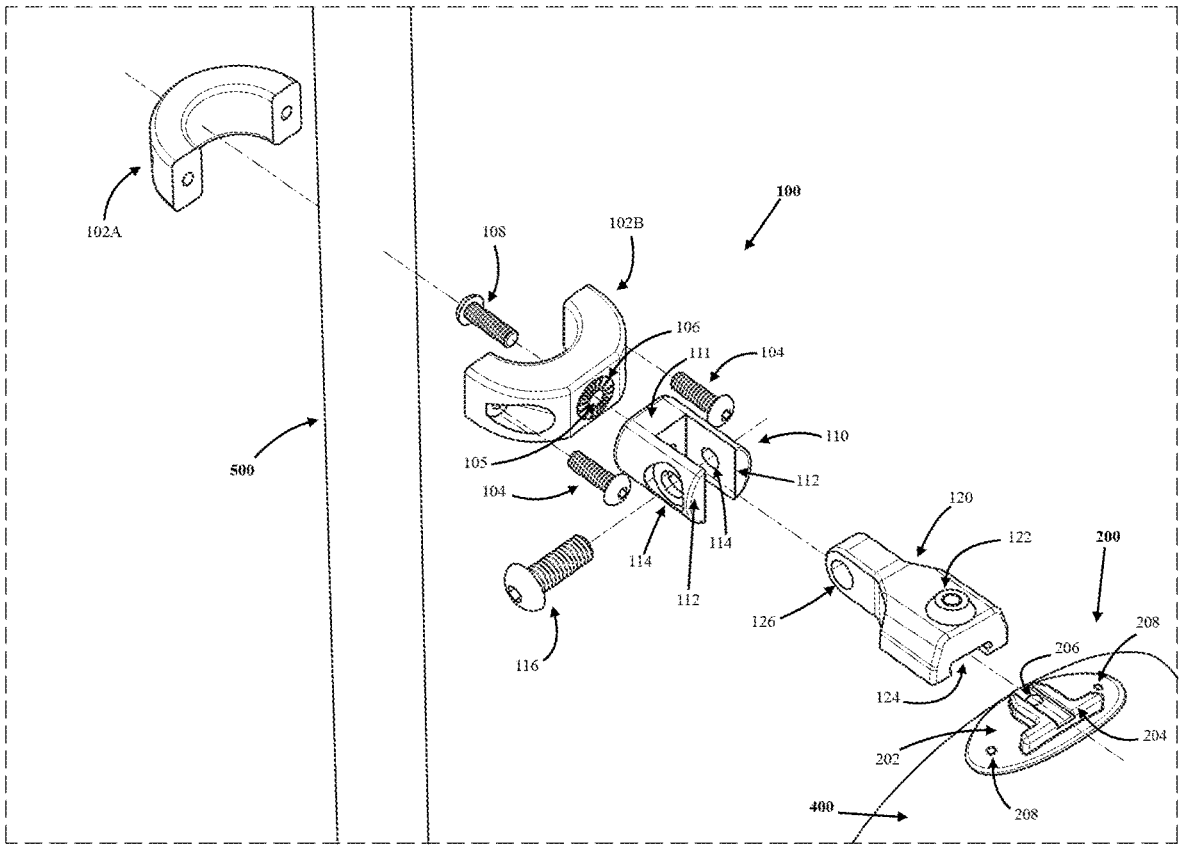
FIG. 3 illustrates an exploded view of a mounting bracket and an anchoring member.

FIG. 3 illustrates an exploded view of the mounting bracket 100. In the non-limiting preferred embodiment, the clamp piece 102 may be comprised of two C-shaped pieces 102A and 102B which are positioned around the supporting structure 500 and fixed in place with a pair of screws 104 adjoining the two C-shaped pieces 102A and 102B such as to securely hold and prevent the clamp piece 102 from sliding on the supporting structure 500. The mounting bracket 100 may be appropriately removed by loosening and removing the screws 104 from the clamp piece 102 and freeing the two C-shaped pieces 102A and 102B to remove from the supporting structure 500. The clamp piece 102 is designed to correspondingly conform to and be placed on a tubular geometric supporting structure 500 in a preferred place chosen by a person using the helmet securing device. In alternate embodiments, the clamp piece may also be fashioned to conform to the different cross section shapes of the supporting structure such as and not limited to circular, square, rectangular, oval, triangular, trapezoidal, and polygonal (such as pentagonal, hexagonal, and so forth).

The swivel piece 110 is configured to be fixedly connected to the clamp piece 102 and the locking device 120. As shown in FIG. 3, the swivel piece 110 is fashioned as resembling a letter U, such that the swivel piece 110 has a pair of parallel arms 112 that extend perpendicularly outward from a base 111. The swivel piece 110 is fashioned such that there is a space between the pair of parallel arms 112 that extend outward. The base 111 includes an aperture (not shown in the figures) that extends through the middle. Further, the pair of parallel arms also include an aperture 114 that extends through each arm and is positioned opposite each other. One of the C-shaped pieces of the clamp piece 102, is adapted to be fixedly connected to the swivel piece 110. The swivel piece 110 may be characterized as having a rotational end and a swivel end, which are the base 111 and the parallel arms 112, respectively. The rotational end (i.e. base 111) is connected to the clamp piece 102 and the swivel end (i.e. pair of parallel arms 112) is connected to the locking piece 120.

The clamp piece 102 and the swivel piece 110 are configured to be fixedly connected to each other. As shown in FIG. 3, the C-shaped piece 102B is configured with an aperture 105 such that it extends through the middle of the C-shaped piece 102B. The swivel piece 110 is also fashioned with an aperture on the base 111. A bolt 108 is passed through the aperture 105 in the middle of the C-shaped clamp piece 102B and the aperture in the base 111 of the swivel piece 110. The C-shaped clamp piece 102B is characterized as having lined grooves 106 on the surface around the aperture 105 on the side that abuts and is joined to the swivel piece 110. Similarly, the swivel piece 110 is also characterized as having lined grooves on the surface around the aperture (not shown in the figures) at the base 111 on the side that abuts and is joined to the C-shaped clamp piece 102B. The lined grooves engage with each other and hold the clamp piece 102 and the swivel piece 110 in place and prevent them from rotating when the bolt 108 is tightened. Loosening the bolt 108 allows the clamp piece 102 and the swivel piece 110 to loosen and also disengage at the lined grooves to permit the swivel piece 110 to rotate. This feature provides flexibility to adjust the position of the locking piece 120 which is connected to the swivel piece 110 such that a helmet 400 may rest properly with the support of gravity depending on the location and position of the supporting structure 500.

As shown in FIG. 1, the swivel piece 110 is connected to the locking piece 120. As described earlier and shown in FIG. 3, the swivel piece 110 is designed with a pair of parallel arms 112 that extend perpendicularly away from the base 111, or the portion that connects to the clamp piece 102. This design creates a space between the two parallel arms 112. The locking piece 120 is designed so it is preferably positioned between the pair of extended parallel arms 112 of the swivel piece 110. The locking piece 120 further includes an aperture 126 on the end that is arranged between the pair of extended parallel arms 112 and positioned such that the apertures 114, 126 on the parallel arms 112 and the locking piece 120, respectively, align and are connected with a bolt 116 that extends through these pieces. By having the locking piece 120 positioned and arranged as such, the locking piece 120 may swivel between the extended arms 112 of the swivel piece 110 at the bolt 116 and rest naturally in a position with the support of gravity.

As shown in FIG. 1 and FIG. 3, the locking piece 120 is also configured with a lock 122. The lock 122 is arranged and positioned at the end opposite the end that connects to the swivel piece 110. The lock 122 may preferably include, and not be limited to, a push lock. The lock design may also include, and not be limited to, mortise cylinder, rim cylinder, key-in-cylinder, and key-lever locks. The locking piece 120 is adapted to engage with the anchoring member 200 and is designed with a grooved section 124 on the bottom side under the lock 122. In referring to FIG. 1, the lock 122 is arranged on the top side of the locking piece 120 and extends through the grooved section 124. The grooved section 124 is designed to engage with the anchoring member 200, as discussed below.

The locking piece 120 is configured to be positioned over and engage with the anchoring member 200 which is arranged on the helmet 400. In FIG. 2, the non-limiting embodiment of the anchoring member 200 is illustrated. The anchoring member 200 may generally be described as having a flat plate 202 and have any geometric shape, including and not limited to, circular, square, rectangular, oval, triangular, trapezoidal, and polygonal (such as pentagonal, hexagonal, and so forth). The anchoring member 200 may be fashioned from materials including, and not limited to, rubber, plastics, resins, foam, and combinations thereof. The anchoring member 200 is adapted to be fixed to the shell of the helmet 400 with rivets (not shown in the figures), and preferably positioned on the back of the helmet 400 near the edge that rests on the nape of a person wearing the helmet 400, as shown in FIG. 3. The flat plate 202 of the anchoring member 200 is configured with apertures 208. The rivets (not shown in the figures) are extended through the apertures 208 on the anchoring member 200 and fixedly secured to the hull of the helmet 400.

Figure 4:
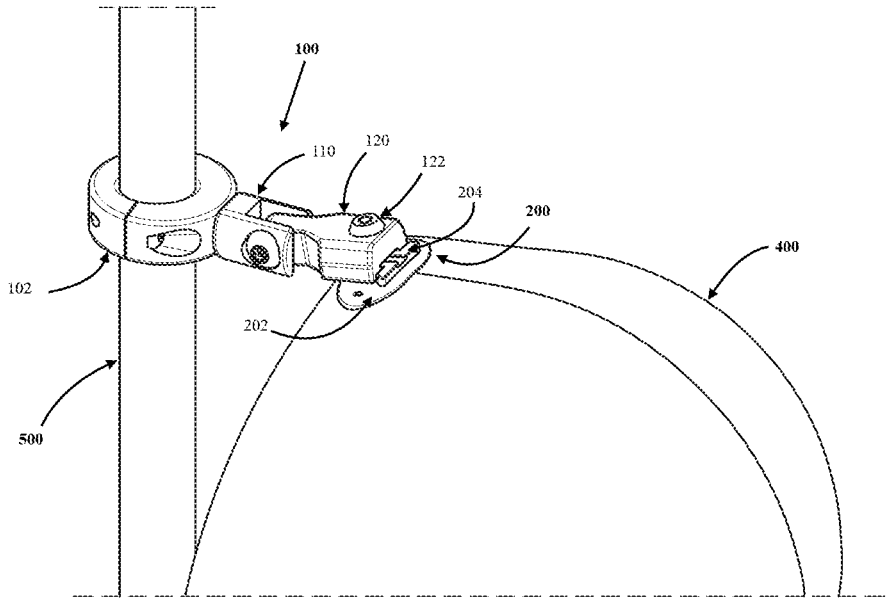
FIG. 4 illustrates a perspective view of a mounting bracket engaged with an anchoring member.

The anchoring member 200 is designed to engage with the grooved section 124 of the lock piece 120. FIG. 2 and FIG. 3 illustrate the anchoring member 200 having a cooperating portion to the grooved section 124 of the lock piece 120 that is designed as a ridge 204 extending from the flat plate 202. The ridge 204 on the anchoring member 200 is further configured with an aperture 206 that aligns with the lock 122 on the lock piece 120. In FIG. 4 the locking piece 120 and anchoring member 200 are operatively coupled when the grooved section 124 of the locking piece 120 slides over the ridge 204 on the anchoring member 200. The lock 122 is operated by means of a key (not shown in the figures) which as a whole configures the locking and unlocking means. Referring back to FIG. 3, the lock 122 is moved into a locked position when it is positioned in the aperture 206 in the ridge 204 of the anchoring member 200. Similarly, the lock 122 is moved into an unlocked position when it is released from the aperture 206 in the ridge 204 of the anchoring member 200.

It is also contemplated that the anchoring member 200 can be designed onto the helmet 400 during the manufacturing process of the helmet (not shown in the figures). The anchoring member 200 may be seamlessly integrated into the hull of the helmet 400. It can be appreciated by people skilled in the arts, that other means of incorporating the anchoring member 200 onto the helmet 400 are within this disclosure of the helmet locking device.

Referring back to FIG. 4, the mounting bracket 100 is shown operatively coupled to the anchoring member 200. The mounting bracket 100 is fixedly connected to the supporting member 500 with the clamp piece 102. The swivel piece 110 is connected to the clamp piece 102 and is rotated and fixed in the position that allows the helmet 400, which is connected to the locking piece 120 through the anchoring member 200, to rest appropriately in the direction of gravity. In FIG. 4, the anchoring member 200 is fixedly mounted to the helmet 400 near the nape and the mounting bracket 100 is engaged with the anchoring member 200 by sliding the locking piece 120 over the ridge 204 on the anchoring member 200. Further, the lock 122 on the locking piece 120 would be used to securely lock the helmet to the mounting device 100 which is secured to the supporting structure 500.

FIG. 5 is an illustration of a generic motorcycle 600 with the mounting bracket 100 fixedly connected to it and the anchoring member 200 connected to the helmet 400. In the figure, the mounting bracket 100 is shown to be mounted on the supporting structure 500 of the motorcycle 600. The mounting bracket 100 may be connected to any tubular shape on the motorcycle 600 that conforms to the clamp piece 102 of the mounting bracket 100. In this figure, the mounting bracket 100 is mounted on the supporting structure 500 that may be characterized as a leg guard. The rider can securely lock the helmet 400 to the motorcycle 600 through this helmet locking device which is comprised of the mounting bracket 100 and the anchoring member 200.

With the helmet securely locked to the motorcycle, the rider can safely leave the helmet and avoid the possibility of theft. Although in the foregoing the system has been described exclusively for fixing a motorcycle safety helmet to the motorcycle, the device can be used to secure the helmet to other objects. Without departing from the inventive concept and functionalities of this invention, the helmet securing device could be modified to mount to other structures and also secure other valuable items that may be integrated with this device.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A releasable helmet securing device for locking a helmet to a supporting structure, comprising:

a mounting bracket adapted to be coupled to the supporting structure, wherein the mounting bracket is comprised of a clamp piece, a swivel piece, and a locking piece;

wherein the clamp piece is connected to a first end of the swivel piece and the locking piece is connected to a second end of the swivel piece, and the locking piece comprises a lock;

an anchoring member adapted to be fixedly mounted to a helmet; and the mounting bracket and the anchoring member configured to be locked or unlocked when the locking piece with the lock and the anchoring member are mutually coupled.

2. The releasable helmet securing device of claim 1, wherein the clamp piece of the mounting bracket is adapted to be connected to the supporting structure.

3. The releasable helmet securing device of claim 2, wherein the clamp piece is adapted to be connected to the supporting structure and is comprised of two pieces that are fixed together around the supporting structure, wherein the two pieces combined have a cross section that conforms to the cross section of the supporting structure selected from the group consisting essentially of a rectangular cross section, a circular cross section, a triangular cross section, a trapezoidal cross section, a polygonal cross section, and an oval cross section.

4. The releasable helmet securing device of claim 1, wherein the clamp piece is adapted to be connected to the swivel piece; and wherein a portion of the clamp piece adjoined to the swivel piece is adapted with an aperture having grooves surrounding the aperture.

5. The releasable helmet securing device of claim 1, wherein the swivel piece has a first rotation end and a second swivel end, wherein the rotation end is adapted to be connected to the clamp piece and configured with an aperture wherein a portion of the aperture adjoining the clamp piece has grooves around the aperture, and wherein the swivel end is adapted to be connected to the locking piece with two parallel arms of the swivel end extending perpendicularly away from the rotation end with apertures that extend through both arms.

6. The releasable helmet securing device of claim 5, wherein the swivel piece is connected to the clamp piece such that the swivel piece can be rotated to different positions relative to the clamp piece.

7. The releasable helmet securing device of claim 5, wherein the locking piece is configured to be positioned between the two parallel arms of the swivel end of the swivel piece, the locking piece having an aperture and a bolt that traverses through the apertures of the two parallel arms and the locking piece.

8. The releasable helmet securing device of claim 7, wherein the locking piece swivels between the two parallel arms of the swivel piece at the bolt that traverses through the apertures of the two parallel arms and the locking piece.

9. The releasable helmet securing device of claim 1, wherein the locking piece is configured with a grooved section and the lock sits adjacent to and traverses through the grooved section; and the grooved section and the lock engage with the anchoring member.

10. The releasable helmet securing device of claim 1, wherein the anchoring member has a structure in the form of a flat plate and a shape selected from the group consisting essentially of a rectangular plate, a circular plate, a triangular plate, a trapezoidal plate, a polygonal plate, and an oval plate, the anchoring member configured with a ridge extending from the flat plate and further having an aperture for receiving the locking piece from the mounting bracket.

11. The releasable helmet securing device of claim 10, wherein the anchoring member slidably receives the locking piece that is to be locked or unlocked when the anchoring member and locking piece are mutually coupled.

12. A releasable helmet securing device for locking a helmet to a supporting structure, comprising:

a mounting bracket adapted to be coupled to the supporting structure, wherein the mounting bracket is comprised of a clamp piece, a swivel piece, and a locking piece, wherein:

the clamp piece is adapted to be connected to a first end of the swivel piece and the locking piece is connected to a second end of the swivel piece, wherein the swivel piece is rotatable at the first end connected to the clamp piece;

wherein the locking piece swivels at the second end connected to the swivel piece;

an anchoring member adapted to be fixedly mounted to a helmet; and the mounting bracket and the anchoring member are configured to be locked or unlocked when the anchoring member and the mounting bracket are mutually coupled.

13. The releasable helmet securing device of claim 12, wherein the clamp piece is comprised of two pieces that are fixed together around the supporting structure, wherein the two pieces fixed together have a cross section that conforms to a cross section of the supporting structure selected from the group consisting essentially of a rectangular cross section, a circular cross section, a triangular cross section, a trapezoidal cross section, a polygonal cross section, and an oval cross section.

14. The releasable helmet securing device of claim 12, wherein the swivel piece has a first rotation end and a second swivel end, wherein the rotation end is adapted to be connected to the clamp piece and configured with an aperture lined with grooves, and wherein the swivel end is adapted to be connected to the locking piece with two parallel arms extending perpendicularly away from the rotation end with apertures that extend through both arms.

15. The releasable helmet securing device of claim 14, wherein the clamp piece adjoined to the swivel piece is adapted with an aperture lined with grooves.

16. The releasable helmet securing device of claim 15, wherein a bolt traverses through the aperture of the swivel piece and the clamp piece to adjoin the pieces, wherein the lined grooves on the swivel piece and the clamp piece are engaged with each other through tightening of the bolt, and the swivel piece is rotatable around the bolt with loosening of the bolt.

17. The releasable helmet securing device of claim 14, wherein the locking piece is configured to be positioned between the two parallel arms of the swivel piece, the locking piece having an aperture and a bolt that traverses through the apertures of the two parallel arms of the swivel piece and the aperture of the locking piece.

18. The releasable helmet securing device of claim 12, wherein the locking piece is configured with a grooved section and a lock that sits adjacent to and traverses through the grooved section, and the grooved section and the lock engage with the anchoring member.

19. The releasable helmet securing device of claim 12, wherein the anchoring member has a structure in the form of a flat plate and having a shape selected from the group consisting essentially of a rectangular plate, a circular plate, a triangular plate, a trapezoidal plate, a polygonal plate, and an oval plate, wherein the anchoring member is configured with a ridge extending from the flat plate and further provided with an aperture for receiving the locking piece from the mounting bracket.

20. The releasable helmet securing device of claim 12, wherein the anchoring member slidably receives the locking piece to be locked or unlocked when the anchoring member and locking piece are mutually coupled.

21. A releasable helmet securing device for locking a helmet to a supporting structure, comprising:

a mounting bracket adapted to be coupled to the supporting structure, wherein the mounting bracket is comprised of a clamp piece, a swivel piece, and a locking piece, wherein:

the clamp piece is comprised of two pieces that are adapted to be fixed together around the supporting structure and configured to be connected to the swivel piece, wherein a portion of the clamp piece adjoining the swivel piece has an aperture that extends through the clamp piece and the aperture has grooves surrounding the aperture;

the swivel piece having a rotation end and a swivel end, the rotation end is configured to be connected to the clamp piece with an aperture wherein a portion of the aperture adjoining the clamp piece has grooves around the aperture, and the swivel end configured to be connected to the locking piece with two parallel arms of the swivel end extending perpendicularly from the rotation end with apertures that extend through both arms;

the locking piece is configured to be positioned between the two parallel arms of the swivel piece, the locking piece having an aperture and a bolt that traverses through the apertures of the two parallel arms and the locking piece, and the locking piece is configured with a grooved section and a lock that sits adjacent to and traverses through the grooved section wherein the grooved section and the lock engage with an anchoring member;

the anchoring member adapted to be fixedly mounted to a helmet, wherein the anchoring member has a structure in the form of a flat plate, the anchoring member is configured with a ridge extending from the flat plate and further having an aperture for receiving the locking piece from the mounting bracket; and the mounting bracket and the anchoring member configured in a complementary manner, wherein the anchoring member slidably receives the locking piece that is to be locked or unlocked when the anchoring member and the locking piece are mutually coupled.

* * * * *